US011557829B2

(12) United States Patent
Chen et al.

(10) Patent No.: US 11,557,829 B2
(45) Date of Patent: Jan. 17, 2023

(54) BASE STATION ANTENNA

(71) Applicant: CommScope Technologies LLC, Hickory, NC (US)

(72) Inventors: Changfu Chen, Suzhou (CN); Jian Zhang, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 84 days.

(21) Appl. No.: 17/199,582

(22) Filed: Mar. 12, 2021

(65) Prior Publication Data

US 2021/0296760 A1 Sep. 23, 2021

(30) Foreign Application Priority Data

Mar. 20, 2020 (CN) ..... 202010198924.2

(51) Int. Cl.

| | |
|---|---|
| ***H01Q 21/24*** | (2006.01) |
| ***H01Q 1/24*** | (2006.01) |
| ***H01Q 19/10*** | (2006.01) |
| ***H01Q 21/26*** | (2006.01) |
| *H01Q 13/10* | (2006.01) |

(Continued)

(52) U.S. Cl.

CPC ..... *H01Q 1/246* (2013.01); *H01Q 19/10* (2013.01); *H01Q 21/26* (2013.01); *H01Q 1/24* (2013.01); *H01Q 5/307* (2015.01); *H01Q 13/10* (2013.01); *H01Q 21/062* (2013.01)

(58) Field of Classification Search

CPC ..... H01Q 1/246; H01Q 19/10; H01Q 21/26; H01Q 13/10; H01Q 1/24; H01Q 5/307; H01Q 21/062

See application file for complete search history.

(56) References Cited

U.S. PATENT DOCUMENTS

2014/0043195 A1* 2/2014 Ho ..... H01Q 21/26 343/770

2014/0168027 A1 6/2014 Katipally

FOREIGN PATENT DOCUMENTS

CN 105356053 A 2/2016
CN 110311229 A 10/2019

OTHER PUBLICATIONS

Liu, Fangfang "Research on Wideband Dual-polarization Base Station Antenna and Passive Intermodulation Distortion in Antenna" Dissertation, South China University of Technology, English translation of abstract (9 pages) (2012).

* cited by examiner

*Primary Examiner* — Joseph J Lauture
(74) *Attorney, Agent, or Firm* — Myers Bigel, P.A.

(57) ABSTRACT

The present invention relates to a base station antenna. The base station antenna comprises: a reflector that is configured to provide a ground plane; a first radiating element array including at least one first cross-polarized radiating element that is arranged on the reflector; and a first parasitic element array including first through third parasitic element pairs, wherein each of the first through third parasitic element pairs includes a pair of parasitic elements that are arranged substantially symmetrically on both sides of the first longitudinal axis, and distances from the first through third parasitic element pairs respectively to the first longitudinal axis increase sequentially, wherein projections of any two of the first parasitic element pair, the second parasitic element pair, the third parasitic element pair, and the at least one first cross-polarized radiating element on the first longitudinal axis at least partly overlap.

23 Claims, 7 Drawing Sheets

(51) Int. Cl.
*H01Q 21/06* (2006.01)
*H01Q 5/307* (2015.01)

BASE STATION ANTENNA

RELATED APPLICATIONS

This patent application claims priority to and the benefit of Chinese Patent Application Serial Number 202010198924.2 filed Mar. 20, 2020, the content of which is hereby incorporated by reference as if recited in full herein.

FIELD

The present invention relates to communications systems and, more particularly, to base station antennas.

BACKGROUND

In a cellular communication system, a geographic area is divided into a series of regions, which are called "cells" that are served by corresponding base stations. Each base station may include one or more antennas that are configured to provide two-way radio frequency ("RF") communication with mobile users in the cell served by the base station. In many cases, each cell is divided into "sectors". In a common configuration, a hexagonal cell is divided into three 120° sectors in the azimuth plane, and each sector is served by one or more base station antennas whose azimuth half-power beam width ("HPBW") is about 65°. Generally, the base station antenna is mounted on a tower, with the radiation pattern (also referred to herein as the "antenna beam") produced by the base station antenna pointing outwards. Base station antennas are usually implemented as linear or planar phased arrays of radiating elements.

SUMMARY

Embodiments of the present invention are directed to base station antennas.

A first aspect of this invention is to provide a base station antenna that includes: a reflector that is configured to provide a ground plane; a first radiating element array including at least one first cross-polarized radiating element that is arranged on the reflector; and a first parasitic element array including first through third parasitic element pairs that respectively extend substantially parallel to a first longitudinal axis of the at least one first cross-polarized radiating element and are respectively coupled to the reflector. Each of the first through third parasitic element pairs includes a pair of parasitic elements that are arranged substantially symmetrically on both sides of the first longitudinal axis, and distances from the first through third parasitic element pairs respectively to the first longitudinal axis increase sequentially. Projections of any two of the first parasitic element pair, the second parasitic element pair, the third parasitic element pair, and the at least one first cross-polarized radiating element on the first longitudinal axis at least partly overlap.

The base station antenna can comprise slant 45 degree radiating elements and parasitic elements can extend at an angle of 45 degrees with respect to a dipole radiator of a respective radiating element. The parasitic elements can be horizontal or vertical parasitics.

Other aspects of the present invention provide a base station antenna that includes a reflector that is configured to provide a ground plane and a radiating element array including horizontally adjacent first and second columns of cross-polarized radiating elements that are respectively arranged on the reflector substantially parallel to a longitudinal axis of the base station antenna. The first column includes a first radiating element, the second column includes a second radiating element. The base station antenna also includes a parasitic element array including first through fifth parasitic elements between the first and second columns that each extend substantially parallel to the longitudinal axis, extend forwardly from the reflector, and are coupled to the reflector, and the first through fifth parasitic elements are sequentially spaced apart from each other in a horizontal direction. Projections of any two of the first parasitic element, the second parasitic element, the third parasitic element, and the first radiating element on the longitudinal axis at least partly overlap, and projections of any two of the third parasitic element, the fourth parasitic element, the fifth parasitic element, and the second radiating element on the longitudinal axis at least partly overlap.

Another aspect of the present invention is directed to a base station antenna that includes: a reflector that is configured to provide a ground plane; a radiating element that is arranged on the reflector, the radiating element including a slant −45 degree dipole radiator with respect to a longitudinal axis of the radiating element and a slant +45 degree dipole radiator with respect to the longitudinal axis; and a parasitic element array including first through third parasitic element pairs that respectively extend substantially parallel to the longitudinal axis and are respectively coupled to the reflector. Each of the first through third parasitic element pairs includes a pair of parasitic elements that are arranged substantially symmetrically on both sides of the longitudinal axis, and distances from the first through third parasitic element pairs respectively to the longitudinal axis increase sequentially, wherein projections of any two of the first parasitic element pair, the second parasitic element pair, the third parasitic element pair, and the radiating element on the longitudinal axis at least partly overlap.

Another aspect of this invention is to provide a base station antenna that includes: a reflector that is configured to provide a ground plane; a cross-polarized radiating element that is arranged on the reflector; and a parasitic element array that includes first through third parasitic element pairs that respectively extend substantially parallel to a horizontal axis of the radiating element and are respectively coupled to the reflector. Each of the first through third parasitic element pairs includes a pair of parasitic elements that are arranged substantially symmetrically on both sides of the horizontal axis, and distances from the first through third parasitic element pairs respectively to the horizontal axis increase sequentially. Projections of any two of the first parasitic element pair, the second parasitic element pair, the third parasitic element pair, and the radiating element on the horizontal axis at least partly overlap.

Yet another aspect is directed to a base station antenna that includes: a reflector that is configured to provide a ground plane; a radiating element that is arranged on the reflector, the radiating element including a slant −45 degree dipole radiator with respect to a horizontal axis of the radiating element and a slant +45 degree dipole radiator with respect to the horizontal axis; and a parasitic element array including first through third parasitic element pairs that respectively extend substantially parallel to the horizontal axis and are respectively coupled to the reflector. Each of the first through third parasitic element pairs includes a pair of parasitic elements that are arranged substantially symmetrically on both sides of the horizontal axis, and distances from the first through third parasitic element pairs respectively to the horizontal axis increase sequentially. Projections of any two of the first parasitic element pair, the second parasitic element pair, the third parasitic element pair, and the radiating element on the horizontal axis at least partly overlap.

Other features of the present invention and advantages thereof will become explicit by means of the following detailed descriptions of exemplary embodiments of the present invention with reference to the drawings.

BRIEF DESCRIPTION OF THE DRAWINGS

The accompanying drawings, which constitute a part of the specification, illustrate embodiments of the present invention and, together with the description, serve to explain the principles of the present invention.

Figure 1A:
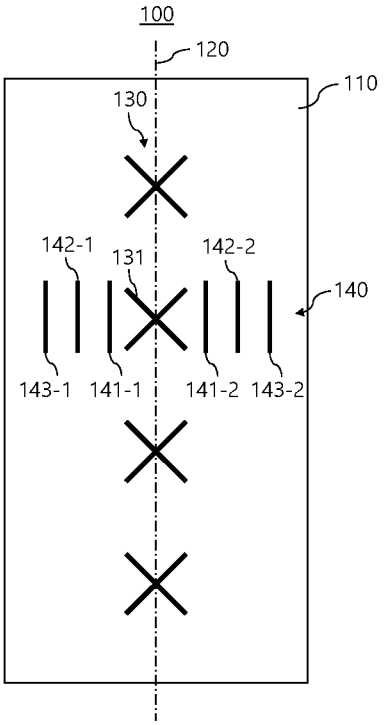
FIGS. 1A through 1D are front views schematically showing antenna assemblies in base station antennas according to some embodiments of the present invention.

Note that, in some cases the same elements or elements having similar functions are denoted by the same reference numerals in different drawings, and description of such elements is not repeated. In some cases, similar reference numerals and letters are used to refer to similar elements, and thus once an element is defined in one figure, it need not be further discussed for following figures.

In order to facilitate understanding, the position, size, range, or the like of each structure illustrated in the drawings may not be drawn to scale. Thus, the invention is not necessarily limited to the position, size, range, or the like as disclosed in the drawings.

DETAILED DESCRIPTION

The present invention will be described with reference to the accompanying drawings, which show a number of example embodiments thereof. It should be understood, however, that the present invention can be embodied in many different ways, and is not limited to the embodiments described below. Rather, the embodiments described below are intended to make the disclosure of the present invention more complete and fully convey the scope of the present invention to those skilled in the art. It should also be understood that the embodiments disclosed herein can be combined in any way to provide many additional embodiments.

The terminology used herein is for the purpose of describing particular embodiments, but is not intended to limit the scope of the present invention. All terms (including technical terms and scientific terms) used herein have meanings commonly understood by those skilled in the art unless otherwise defined. For the sake of brevity and/or clarity, well-known functions or structures may be not described in detail.

Herein, when an element is described as located "on" "attached" to, "connected" to, "coupled" to or "in contact with" another element, etc., the element can be directly located on, attached to, connected to, coupled to or in contact with the other element, or there may be one or more intervening elements present. In contrast, when an element is described as "directly" located "on", "directly attached" to, "directly connected" to, "directly coupled" to or "in direct contact with" another element, there are no intervening elements present. In the description, references that a first element is arranged "adjacent" a second element can mean that the first element has a part that overlaps the second element or a part that is located above or below the second element.

Herein, the foregoing description may refer to elements or nodes or features being "connected" or "coupled" together. As used herein, unless expressly stated otherwise, "connected" means that one element/node/feature is electrically, mechanically, logically or otherwise directly joined to (or directly communicates with) another element/node/feature. Likewise, unless expressly stated otherwise, "coupled" means that one element/node/feature may be mechanically, electrically, logically or otherwise joined to another element/node/feature in either a direct or indirect manner to permit interaction even though the two features may not be directly connected. That is, "coupled" is intended to encompass both direct and indirect joining of elements or other features, including connection with one or more intervening elements.

Herein, terms such as "upper", "lower", "left", "right", "front", "rear", "high", "low" may be used to describe the spatial relationship between different elements as they are shown in the drawings. It should be understood that in addition to orientations shown in the drawings, the above terms may also encompass different orientations of the device during use or operation. For example, when the device in the drawings is inverted, a first feature that was described as being "below" a second feature can be then described as being "above" the second feature. The device may be oriented otherwise (rotated 90 degrees or at other orientation), and the relative spatial relationship between the features will be correspondingly interpreted.

Herein, the term "A or B" used through the specification refers to "A and B" and "A or B" rather than meaning that A and B are exclusive, unless otherwise specified. The term "exemplary", as used herein, means "serving as an example, instance, or illustration", rather than as a "model" that would be exactly duplicated. Any implementation described herein as exemplary is not necessarily to be construed as preferred or advantageous over other implementations. Furthermore, there is no intention to be bound by any expressed or implied theory presented in the detailed description.

Herein, the term "substantially", is intended to encompass any slight variations due to design or manufacturing imperfections, device or component tolerances, environmental effects and/or other factors. The term "substantially" also allows for variation from a perfect or ideal case due to parasitic effects, noise, and other practical considerations that may be present in an actual implementation.

Herein, certain terminology, such as the terms "first", "second" and the like, may also be used in the following description for the purpose of reference only, and thus are not intended to be limiting. For example, the terms "first", "second" and other such numerical terms referring to structures or elements do not imply a sequence or order unless clearly indicated by the context.

Further, it should be noted that, the terms "comprise", "include", "have" and any other variants, as used herein, specify the presence of stated features, steps, operations, elements, and/or components, but do not preclude the presence or addition of one or more other features, steps, operations, elements, components, and/or groups thereof.

It should be noted that when multiple identical or similar elements are provided herein, two-part reference numbers (e.g., parasitic element 141-1) may be used to label them in the drawings. These elements may be individually referred to herein by all of their reference numbers (e.g., parasitic elements 141-1 and 141-2) and may be collectively referred to by the first part of their reference numbers (e.g., parasitic element pair 141).

The base station antennas according to some embodiments of the present invention each include first through third parasitic element pairs that respectively extend substantially parallel to the longitudinal or horizontal axis of a cross-polarized radiating element, and are respectively coupled to the reflector. Each parasitic element pair includes a pair of parasitic elements that are arranged substantially symmetrically on both sides of the axis. Distances from the first through third parasitic element pairs respectively to the axis increase sequentially. Projections of any two of the first parasitic element pair, the second parasitic element pair, the third parasitic element pair, and the cross-polarized radiating element on the axis at least partly overlap.

The cross-polarized radiating element includes two radiators that are arranged to be orthogonal to each other, for example, a slant −45 degree dipole radiator and a slant +45 degree dipole radiator with respect to the axis. For example, when the +45 degree dipole radiator is being operated, in the non-ideal case, a relatively small amount of electromagnetic radiation in the −45 degree direction is generated. By adjusting the sizes and arrangements of the parasitic elements near the cross-polarized radiating element, it is possible to increase the electromagnetic radiation in the +45 degree direction and reduce the electromagnetic radiation in the −45 degree direction when the +45 degree dipole radiator is being operated. Therefore, the base station antennas according to the embodiments of the present invention can provide an improved cross polarization ratio ("CPR") over sector.

The base station antenna according to an embodiment of the present invention may be, for example, a non-miniaturized antenna, an antenna with a high operating frequency band (for example, 2.3 to 3.8 GHz frequency band), or a MIMO antenna. For example in a MIMO antenna, the spacing between two adjacent columns of radiating elements may be about a wavelength corresponding to a center frequency of an operating frequency band of the radiating elements. Due to the relatively large physical spacing, the isolation between the two columns may usually meet the requirement (e.g., −30 dB~−40 dB), and it may not be necessary to add additional parasitic elements between the adjacent two columns so as to improve the isolation between the two columns. In the event that additional isolation is necessary, the spacing between the two columns is large enough to arrange the above-mentioned parasitic elements, so at least a part of the parasitic elements in the base station antenna according to the embodiments of the present invention may be easily arranged between the two columns.

Embodiments of the present invention will now be described in more detail with reference to the accompanying drawings.

FIGS. 1A through 1D are front views schematically showing antenna assemblies 100, 100', 100", and 100'" of base station antennas according to some embodiments of the present invention. The base station antenna 100 includes a reflector 110 that is configured to provide a ground plane, and a radiating element array 130 and a parasitic element array 140 that are both provided on the reflector 110. The radiating element array 130 includes a plurality of cross-polarized radiating elements that are arranged on the reflector 110 substantially along a longitudinal axis 120 of a radiating element 131. Although the radiating elements in the array 130 that are arranged in a column in the illustrated embodiment are aligned along the longitudinal axis 120, it will be appreciated that at least some of the radiating elements may be staggered horizontally to either side of the longitudinal axis 120 in a known manner. In addition, although the illustrated array 130 includes a plurality of radiating elements, it will be appreciated that the array 130 may include only one radiating element 131.

The parasitic element array 140 includes three parasitic element pairs 141 through 143 that respectively extend substantially parallel to the axis 120 and are respectively coupled to the reflector 110. Distances from the three pairs 141 through 143 to the axis 120 increase sequentially. Each of the parasitic element pairs 141 through 143 include a pair of parasitic elements 141-1 and 141-2, 142-1 and 142-2, or 143-1 and 143-2. Each pair of parasitic elements 141-1 and 141-2, 142-1 and 142-2, or 143-1 and 143-2 are arranged substantially symmetrically on both sides of the axis 120. In the illustrated embodiment, the projection of each of the parasitic element pairs 141 through 143 on the axis 120 extends over the entire projection of the radiating element 131 on the axis 120. It will be appreciated that in other embodiments, projections of any two of the parasitic element pair 141, the parasitic element pair 142, the parasitic element pair 143, and the radiating element 131 on the axis 120 at least partly overlap.

Figure 2:
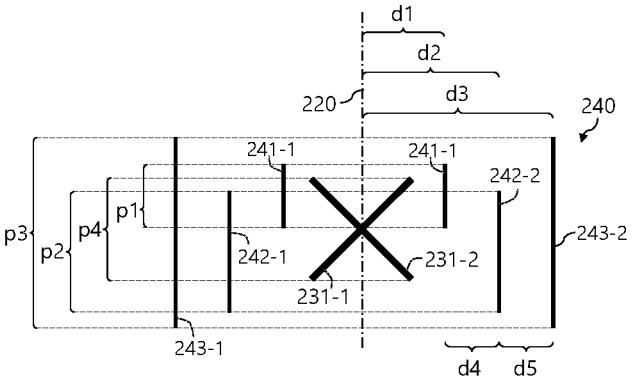
FIG. 2 is a diagram schematically showing distances of parasitic element pairs to a longitudinal axis, and regions of projections of the parasitic element pairs and a radiating element on the longitudinal axis.

A distance from a parasitic element pair to an axis and a projection of an element on the axis will be described with reference to FIG. 2. Respective distances dl through d3 from the parasitic element pairs 241 through 243 in the parasitic element array 240 to the longitudinal axis 220 of the radiating element 231, respective projection regions p1 through p3 of the parasitic element pairs 141 through 143 on the longitudinal axis 220, and a projection region p4 of the radiating element 231 on the longitudinal axis 220 are respectively shown in FIG. 2. Since a pair of parasitic elements in a parasitic element pair are arranged substantially symmetrically on both sides of the longitudinal axis, the distance from the parasitic element pair to the longitudinal axis referred to herein may be the distance from one parasitic element in the parasitic element pair to the longitudinal axis. For example, the distance dl from the parasitic element pair 241 that includes the parasitic elements 241-1 and 241-2 to the longitudinal axis 220 is the distance from the parasitic element 241-1 or 241-2 to the longitudinal axis 220. Similarly, a projection of a parasitic element pair on the longitudinal axis referred to herein may be the projection of one parasitic element in the parasitic element pair on the longitudinal axis. For example, the projection region p2 of the parasitic element pair 242 that includes the parasitic elements 242-1 and 242-2 on the longitudinal axis 220 is the projection region of the parasitic element 242-1 or 242-2 on the longitudinal axis 220. A projection of a cross-polarized radiating element on the longitudinal axis referred to herein may be the projection of any of the dipole radiators (e.g., 231-1, 231-2) included in the cross-polarized radiating element (e.g., 231) on the longitudinal axis. In the embodiment shown in FIG. 2, projections of any two of the parasitic element pair 241, the parasitic element pair 242, the parasitic element pair 243, and the cross-polarized radiating element 231 on the longitudinal axis 220 at least partly overlap.

Figure 1B:
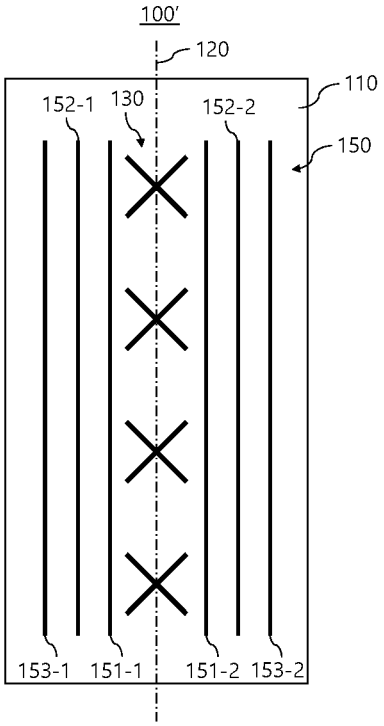

Referring to FIG. 1B, the base station antenna 100' includes a reflector 110, a radiating element array 130, and a parasitic element array 150. The parasitic element array 150 includes three parasitic element pairs 151 through 153 that respectively extend substantially parallel to the axis 120 and are respectively coupled to the reflector 110. Distances from the three pairs 151 through 153 to the axis 120 increase sequentially. The parasitic element pairs 151 through 153 include a respective pair of parasitic elements 151-1 and 151-2, 152-1 and 152-2, and 153-1 and 153-2, which are arranged substantially symmetrically on both sides of the axis 120, respectively. The projection of each parasitic element pair 151 through 153 on the axis 120 extends over the entire projection of the radiating element array 130 on the axis 120.

Figure 1C:
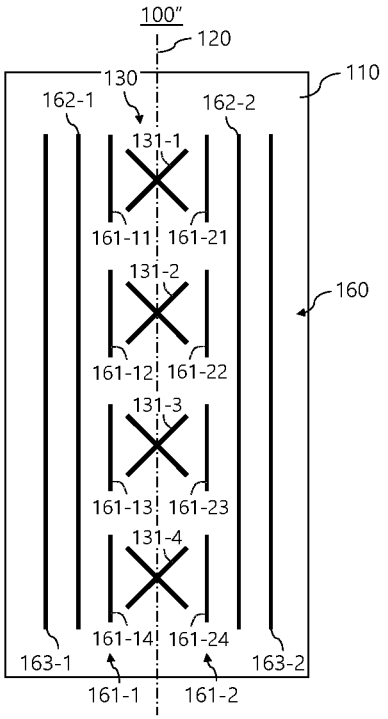

Referring to FIG. 1C, the base station antenna 100" includes a reflector 110, a radiating element array 130, and a parasitic element array 160. The parasitic element array 160 includes three parasitic element pairs 161 through 163 that respectively extend substantially parallel to the axis 120 and are respectively coupled to the reflector 110. Distances from the three pairs 161 through 163 to the axis 120 increase sequentially. The parasitic element pairs 161 through 163 include a respective pair of parasitic elements 161-1 and 161-2, 162-1 and 162-2, and 163-1 and 163-2, which are arranged substantially symmetrically on both sides of the axis 120, respectively. The parasitic element 161-1 includes a plurality of parasitic cells 161-11 through 161-14 that extend substantially parallel to the axis 120 and are spaced apart from each other. The parasitic element 161-2 includes a plurality of parasitic cells 161-21 through 161-24 that extend substantially parallel to the axis 120 and are spaced from each other. The parasitic cells 161-21 through 161-24 are symmetrical to the parasitic cells 161-11 through 161-14 with respect to the axis 120. In the illustrated embodiment, the projection of each of the parasitic cells 161-11 through 161-14, and 161-21 through 161-24 on the axis 120 extends the entire projection of the corresponding radiating element 131-1 through 131-4 on the axis 120. It will be appreciated that, in other embodiments, the projection of each of the parasitic cells 161-11 through 161-14, and 161-21 through 161-24 on the axis 120 and the projection of the corresponding radiating element 131-1 through 131-4 on the axis 120 at least partly overlap.

Figure 1D:
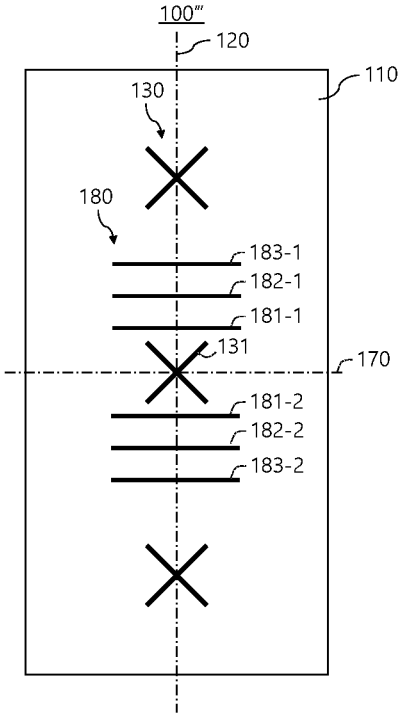

Referring to FIG. 1D, the base station antenna 100''' includes a reflector 110, a radiating element array 130, and a parasitic element array 180. The parasitic element array 180 includes three parasitic element pairs 181 through 183 that extend substantially parallel to a horizontal axis 170 of the radiating element 131, respectively, and are coupled to the reflector 110, respectively. Distances from the three pairs 181 through 183 to the axis 170 increase sequentially. The parasitic element pairs 181 through 183 include a respective pair of parasitic elements 181-1 and 181-2, 182-1 and 182-2, and 183-1 and 183-2, which are arranged substantially symmetrically on both sides of the axis 170, respectively. In the illustrated embodiment, the projection of each of the parasitic element pairs 181 through 183 on the axis 170 extends over the entire projection of the radiating element 131 on the axis 170. It will be appreciated that in other embodiments, the projections of any two of the parasitic element pair 181, the parasitic element pair 182, the parasitic element pair 183, and the radiating element 131 on the horizontal axis 170 at least partly overlap.

In the foregoing, the embodiments in which parasitic elements are provided on both sides of the longitudinal axis or on both sides of the horizontal axis of the radiating element have been described in conjunction with the drawings. It will be appreciated that in other embodiments, parasitic elements may be provided both on both sides of the longitudinal axis and on both sides of the horizontal axis of the radiating element.

It should be noted that, a longitudinal axis herein refers to a virtual axis (no physical structure used as an axis is necessary) extending along the length direction (also referred to as the vertical direction) of the base station antenna, and a horizontal axis refers to a virtual axis extending along the width direction (also referred to as the horizontal direction) of the base station antenna. For simplicity, the longitudinal axes and/or the horizontal axes are not shown in some drawings, and it will be appreciated that such virtual axes exist in the embodiments depicted in these drawings. Although the longitudinal axis 120 shown in FIGS. 1A through 1D and the horizontal axis 170 shown in FIG. 1D both extend through the middle of the base station antenna, it will be appreciated that the axis referred to herein is not limited to extending through the middle of the base station antenna.

Each parasitic element in the parasitic element array includes a conductor portion extending substantially forwardly from the reflector. The conductor portion is substantially perpendicular to the reflector. A pair of the conductor portions of each of the parasitic element pairs extend forwardly substantially the same length from the reflector. The effect of the parasitic element array on the CPR over sector may be tuned by adjusting the length of the conductor portion of each parasitic element extending forwardly from the reflector. In some embodiments, the length of the conductor portion extending forwardly from the reflector is smaller than the length of the corresponding radiating element extending forwardly from the reflector, so as not to affect the width of the antenna beam. In some embodiments, for example when the parasitic element is relatively near the corresponding radiating element, the length of the conductor portion extending forwardly from the reflector is less than or substantially equal to half the length of the corresponding radiating element extending forwardly from the reflector. For example, for a base station antenna with an operating frequency band of 2.3 to 3.8 GHz, the length of the radiating element extending forwardly from the reflector (that is, the distance between the radiating arm of the radiating element and the reflector) may be approximately a quarter of the wavelength corresponding to the center frequency of the operating frequency band, such as 25 mm. In these embodiments, the length of the conductor portion extending forwardly from the reflector may be less than or substantially equal to 12.5 mm. In addition, the effect of the parasitic element array on the CPR over sector may be tuned by adjusting the distance between the conductor portions of two parasitic elements. In some embodiments, on a side of the radiating element, the distances between the conductor portions of every two adjacent parasitic elements may be substantially constant. In some embodiments, on a side of the radiating element, the distances between the conductor portions of every two adjacent parasitic elements may be varied.

Figure 3A:
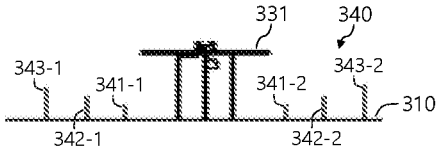
FIGS. 3A through 3D are top views schematically showing antenna assemblies in base station antennas according to some embodiments of the present invention.

Referring to FIG. 3A, the parasitic element array 340 includes parasitic element pairs 341 through 343. The parasitic element pairs 341 through 343 include a respective pair of parasitic elements 341-1 and 341-2, 342-1 and 342-2, and 343-1 and 343-2, respectively, which are arranged on both sides of the radiating element 331. The lengths of the conductor portions in the parasitic element pairs 341 through 343 extending forwardly from the reflector 310 increase sequentially. For example, for a base station antenna with an operating frequency band of 2.3 to 3.8 GHz, the lengths of the conductor portions in the parasitic element pairs 341 through 343 may be 5 mm, 7.5 mm, and 10 mm, respectively.

Figure 3B:
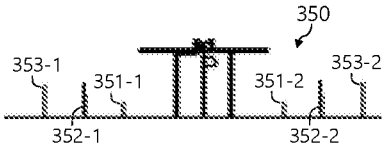

Referring to FIG. 3B, the parasitic element array 350 includes parasitic element pairs 351 through 353. The parasitic element pairs 351 through 353 include a respective pair of parasitic elements 351-1 and 351-2, 352-1 and 352-2, and 353-1 and 353-2, respectively, which are disposed on both sides of the radiating element. The length of the conductor portion in the parasitic element pair 351 extending forwardly is smaller than either the length of the conductor portion in the parasitic element pair 352 extending forwardly or the length of the conductor portion in the parasitic element pair 353 extending forwardly. The length of the conductor portion in the parasitic element pair 352 extending forwardly and the length of the conductor portion in the parasitic element pair 353 extending forwardly are substantially the same. For example, for a base station antenna with an operating frequency band of 2.3 to 3.8 GHz, the lengths of the conductor portions of the parasitic element pairs 351 through 353 may be 5.5 mm, 10 mm, and 10 mm, respectively.

Figure 3C:
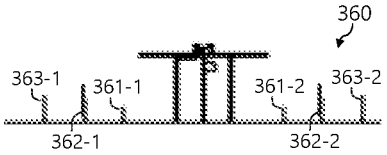

Referring to FIG. 3C, the parasitic element array 360 includes parasitic element pairs 361 through 363. The parasitic element pairs 361 through 363 include a respective pair of parasitic elements 361-1 and 361-2, 362-1 and 362-2, and 363-1 and 363-2, respectively, which are disposed on both sides of the radiating element. The length of the conductor portion in the parasitic element pair 361 extending forwardly is smaller than either the length of the conductor portion in the parasitic element pair 362 extending forwardly or the length of the conductor portion in the parasitic element pair 363 extending forwardly. The length of the conductor portion in the parasitic element pair 362 extending forwardly is larger than the length of the conductor portion in the parasitic element pair 363 extending forwardly. For example, for a base station antenna with an operating frequency band of 2.3 to 3.8 GHz, the lengths of the conductor portions in the parasitic element pairs 361 through 363 may be 5.5 mm, 10 mm, and 7.5 mm, respectively.

Figure 3D:
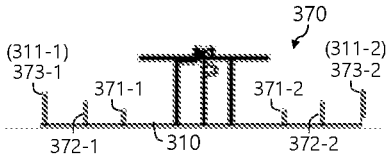
Figure 4A:
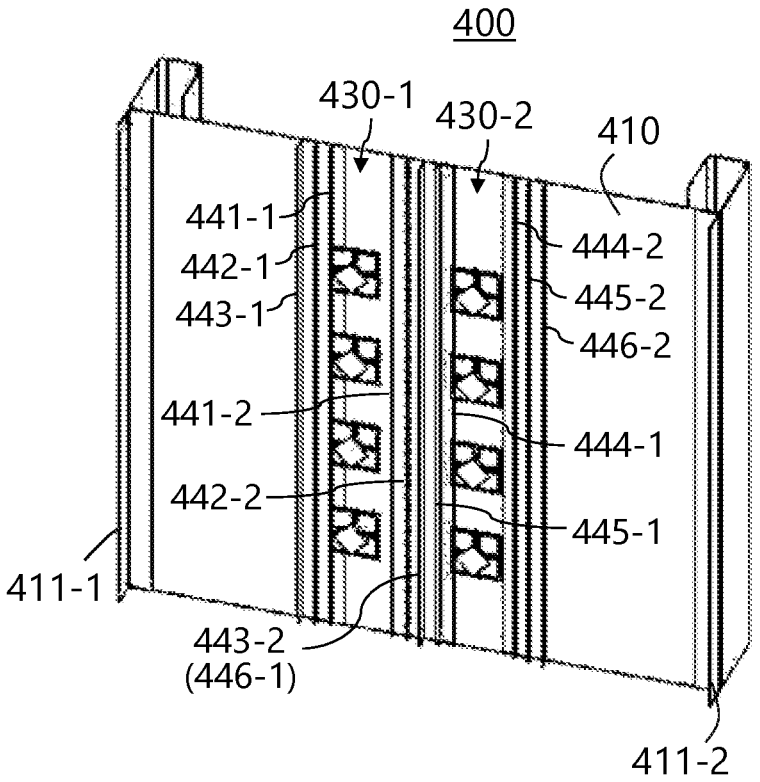
FIG. 4A is a perspective view schematically showing an antenna assembly in a base station antenna according to an embodiment of the present invention.
Figure 4B:
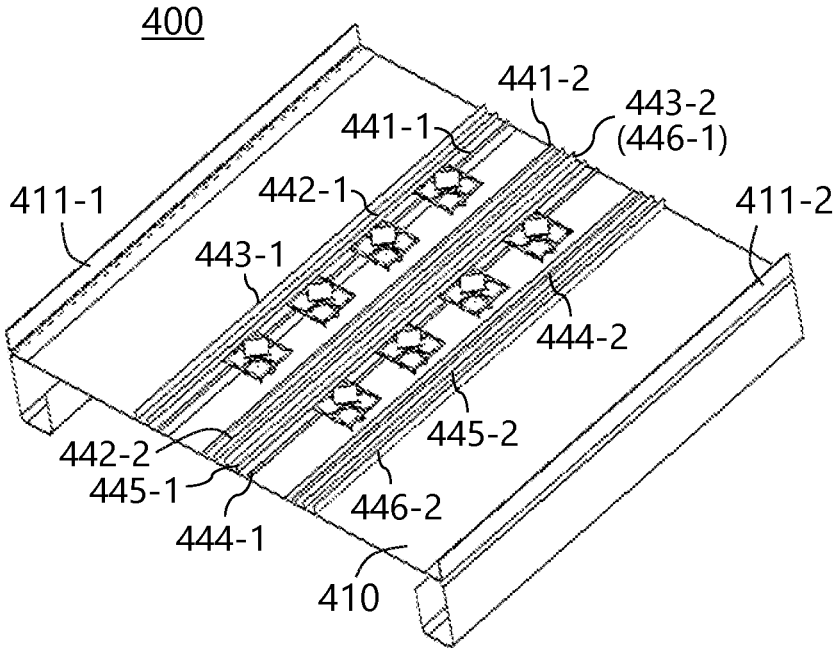
FIG. 4B is a perspective view schematically showing the antenna assembly in FIG. 4A from another direction.
Figure 4C:
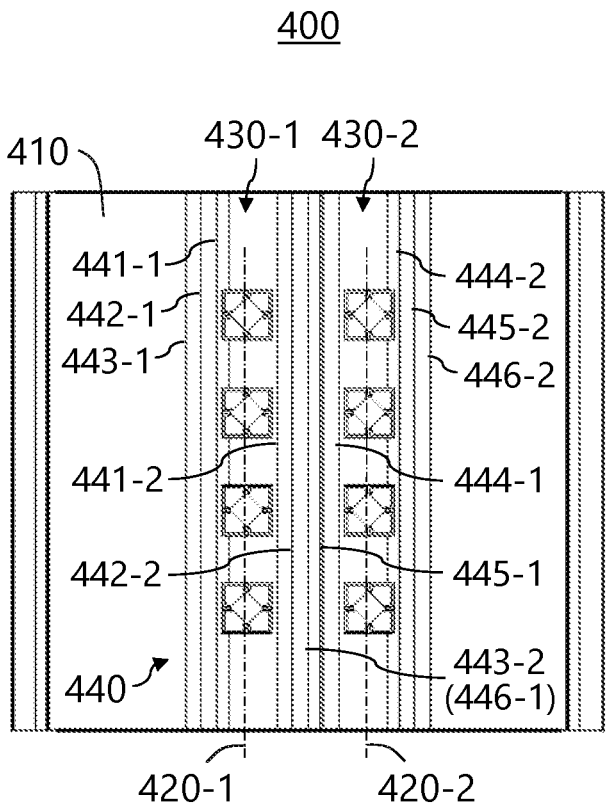
FIG. 4C is a front view schematically showing the antenna assembly in FIG. 4A.
Figure 4D:
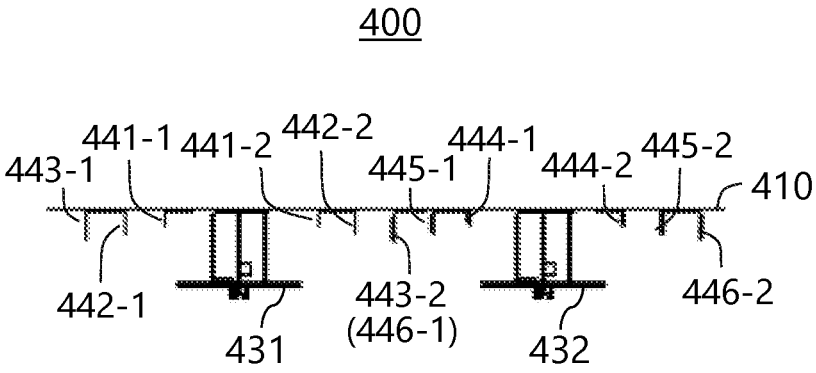
FIG. 4D is a top view schematically showing a part of the antenna assembly in FIG. 4A.

In an embodiment, the reflector has a forwardly-extending flange on an edge that is on a side of a longitudinal axis of the base station antenna, for example so as to improve the radiation pattern of the antenna. The flange may have a common portion with a parasitic element mentioned above, for example, may serve as the parasitic element. As shown in FIG. 3D, the parasitic element array 370 includes parasitic element pairs 371 through 373. The parasitic element pairs 371 through 373 include a respective pair of parasitic elements 371-1 and 371-2, 372-1 and 372-2, and 373-1 and 373-2, respectively, which are disposed on both sides of the radiating element. The reflector has forwardly-extending flanges 311-1 and 311-2 on both edges thereof, respectively. The flange 311-1 and the parasitic element 373-1 have a common portion (for example, the flange 311-1 acts as the parasitic element 373-1), and the flange 311-2 and the parasitic element 373-2 have a common portion (for example, the flange 311-2 acts as the parasitic element 373-2).

FIGS. 4A through 4D illustrate an antenna assembly 400 in a base station antenna according to an embodiment of the present invention. The antenna assembly 400 includes a reflector 410 that is configured to provide a ground plane, a radiating element array 430 and a parasitic element array 440 that are arranged on the reflector 410. The reflector 410 has flanges 411-1 and 411-2 extending forwardly on both side edges thereof. The radiating element array 430 includes adjacent first and second columns 430-1 and 430-2 of cross-polarized radiating elements, which are arranged substantially along longitudinal axes 420-1 and 420-2, respectively. The parasitic element array 440 includes six parasitic element pairs 441 through 446 that each extend substantially parallel to the axis 420 and are coupled to the reflector 410. Distances from the parasitic element pairs 441 through 443 to the axis 420-1 are sequentially increased, wherein the parasitic elements 441-1 through 443-1 are arranged on the side of the first column 430-1 that is away from the second column 430-2, and the parasitic elements 441-2 through 443-2 are arranged on the other side of the first column 430-1. Distances from the parasitic element pairs 444 through 446 to the axis 420-2 are sequentially increased, wherein the parasitic elements 444-1 through 446-1 are arranged on the side of the second column 430-2 that is close to the first column 430-1, and the parasitic elements 444-2 through 446-2 are arranged on the other side of the second column 430-2. The parasitic element 443-2 and the parasitic element 446-1 have a common portion (e.g., the parasitic element 443-2 acts as the parasitic element 446-1). Accordingly, the parasitic element array 440 includes sequentially five parasitic elements 441-2, 442-2, 443-2(446-1), 445-1, 444-1 from the first column 430-1 to the second column 430-2. In the illustrated embodiment, the parasitic element 443-2 and the parasitic element 446-1 have a common portion. It will be appreciated that, if the distance between the first column 430-1 and the second column 430-2 is sufficient in another embodiment, the parasitic element 443-2 and the parasitic element 446-1 may not have any common portion (e.g., being different elements).

In the illustrated embodiment, the projection of each parasitic element on the axis 420 extends over the entire projection of the radiating element array 430 on the axis 420. It will be appreciated that in other embodiments, projections of any two of the parasitic element pair 441, the parasitic element pair 442, the parasitic element pair 443, and the at least one radiating element 431 in the first column 430-1 on the axis 420-1 at least partly overlap, and projections of any two of the parasitic element pair 444, the parasitic element pair 445, the parasitic element pair 446, and the at least one radiating element 432 in the second column 430-2 on the axis 420-2 at least partly overlap.

Figure 8:
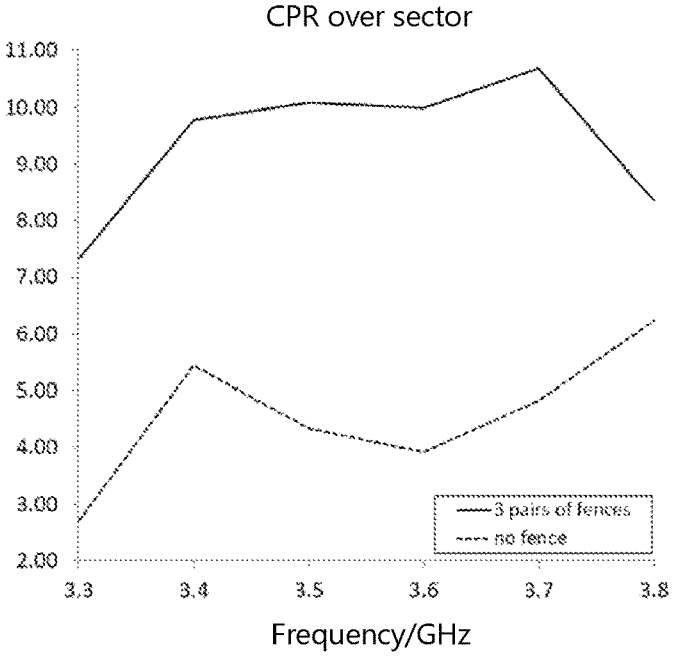
FIG. 8 is a line graph of the cross-polarization ratio over sector of base station antennas as a function of frequency, where the solid line represents cross polarization ratio over sector of a base station antenna including the antenna assembly in FIG. 4A, and the dotted line represents that of a base station antenna including the antenna assembly in FIG. 4A but with the parasitic element array being removed.
Figure 9A:
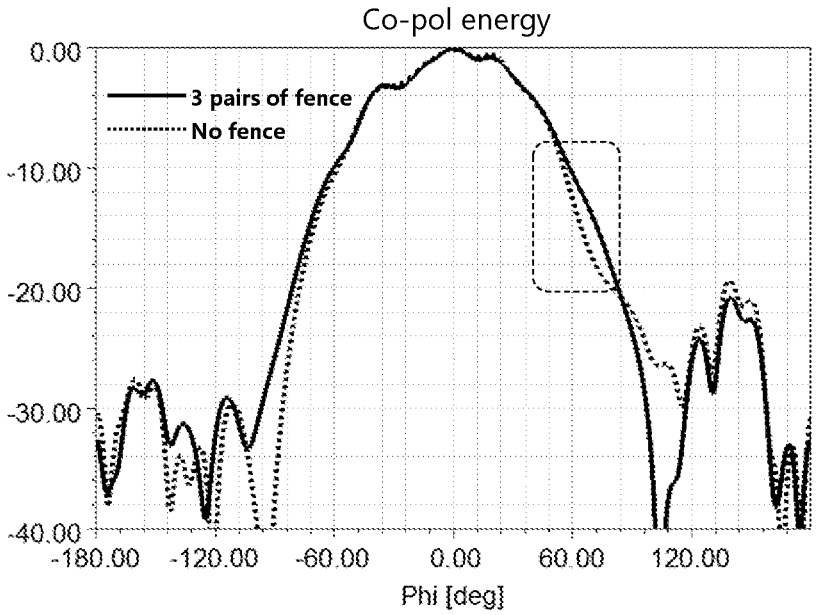
FIGS. 9A and 9B are respective graphs of the main polarization energy and the cross-polarization energy of base station antennas on the azimuth plane, where the solid line represents performance of a base station antenna including the antenna assembly in FIG. 4A, and the dotted line represents that of a base station antenna including the antenna assembly in FIG. 4A but with the parasitic element array being removed.
Figure 9B:
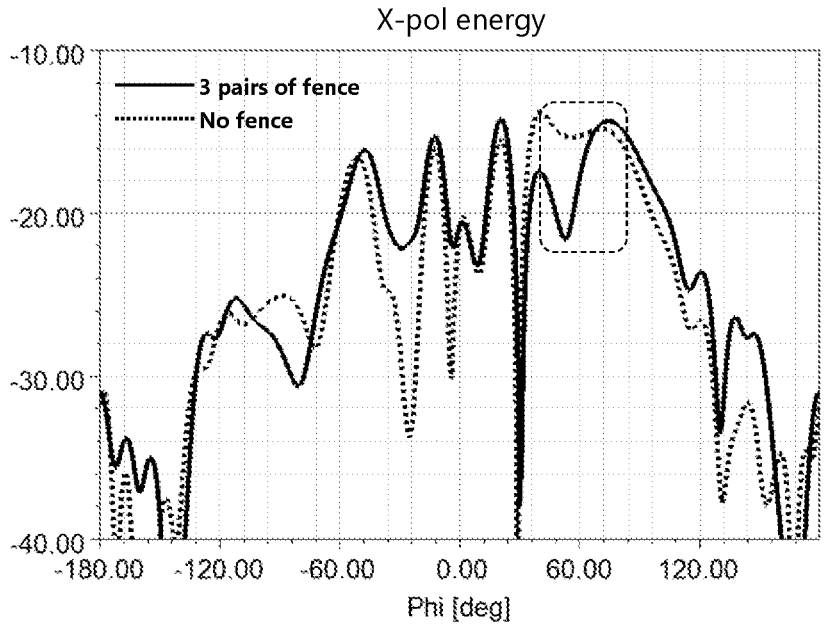

FIGS. 9A and 9B are respective graphs of the main polarization energy (Co-pol energy) and the cross-polarization energy (X-pol energy) of base station antennas in the azimuth plane, whose operating frequency is 3.3 GHz. The solid line represents the main polarization energy and the cross-polarization energy of a base station antenna including the antenna assembly 400, and the dotted line represents the main polarization energy and the cross-polarization energy of a base station antenna including the antenna assembly 400 but with the parasitic element array 440 therein removed. It can be seen that near +60 degrees of the maximum radiation direction in the azimuth plane, the base station antenna including the parasitic element array 440 may provide an increased main polarization energy and a reduced cross polarization energy. FIG. 8 shows the CPR over sector as a function of frequency in the maximum radiation direction, and the frequency range is from 3.3 to 3.8 GHz. The solid line represents the CPR over sector of a base station antenna including the antenna assembly 400, and the dotted line represents the CPR over sector of a base station antenna including the antenna assembly 400 but with the parasitic element array 440 therein being removed. It can be seen that the base station antenna including the parasitic element array 440 may improve the CPR over sector by more than 4.48 dB.

Each parasitic element in the parasitic element array may include a first portion that extends forwardly from the reflector. The first portion includes a first conductor that is substantially perpendicular to the reflector. In an embodiment, the first portion that includes the first conductor may be formed of a metal plate (sheet). In another embodiment, the first portion may be formed of a Printed Circuit Board (PCB), and the first conductor is the conductor printed on the PCB. In an embodiment, the first portion may be configured as a protrusion of the reflector that extends forwardly. In another embodiment, the first portion may be soldered to the reflector so as to be mounted and galvanically connected to the reflector. In other embodiments, the first portion may be mounted or coupled to the reflector in other ways.

FIGS. 5A through 7B show parasitic elements according to some embodiments of the present invention. Any of the parasitic elements or any of the parasitic cells in the above embodiments may be implemented as any of the parasitic elements shown in FIGS. 5A through 5D and 7B. Any two adjacent parasitic elements or any two adjacent parasitic cells (and located on the same side of the corresponding radiating element) in the above embodiments may be implemented as any of parasitic elements shown in FIGS. 6A and 6B.

Figure 5A:
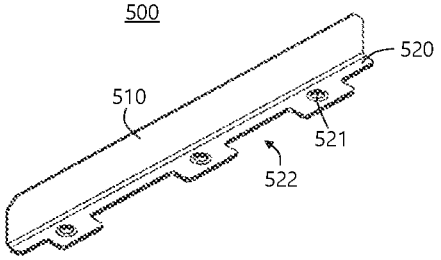
FIGS. 5A through 5D are perspective views schematically showing parasitic elements in base station antennas according to some embodiments of the present invention.
Figure 5B:
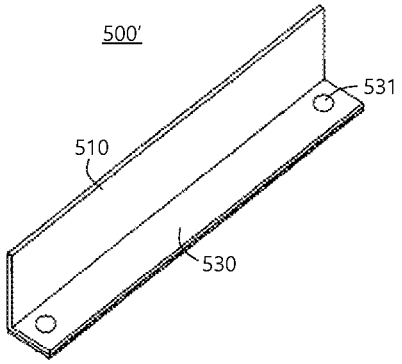
Figure 5C:
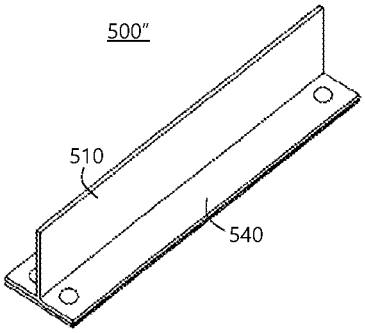
Figure 5D:
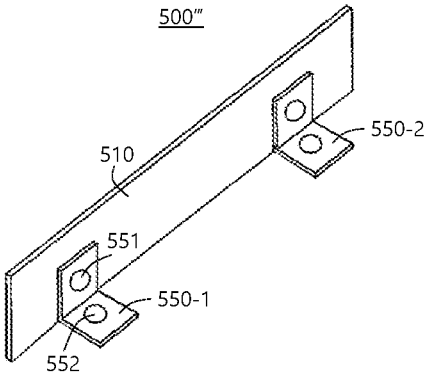

Referring to FIG. 5D, the parasitic element 500' includes a first portion 510 including a conductor that extends forwardly from the reflector. The first portion 510 is substantially perpendicular to the reflector. The first portion 510 may be mounted on the reflector through mounting members 550-1, 550-2. The mounting member 550 may be provided with openings 551, 552 configured to receive screws, rivets or other fasteners such that the first portion 510 is mounted to the reflection via the screws, rivets or other fasteners, and the mounting member 550. In an embodiment, the mounting member 550 may be formed of a dielectric material such that the first portion 510 is contacted with so as to be galvanically connected to the reflector through its edge that is contacted with the reflector, or the first portion 510 is close to so as to be capacitively coupled to the reflector through its edge that is near the reflector. In another embodiment, the mounting member 550 may be formed of a conductive material, so that the first portion 510 is galvanically connected to the reflector through the mounting member 550, or capacitively coupled to the reflector through a dielectric material (such as a gasket, an adhesive, etc.) that is provided between the mounting member 550 and the reflector. Compared to being galvanically connected to the reflector, the first portion 510 being capacitively coupled to the reflector may reduce passive intermodulation interference. It will be appreciated that, in other embodiments, the mounting member 550 may include no opening, and the first portion 510 may be connected to the mounting member 550 by welding, bonding, or the like so as to be coupled to the reflector.

The parasitic element may further include a second portion that extends substantially parallel to the reflector. The second portion includes a second conductor. As shown in FIG. 5A, the parasitic element 500 includes a first portion 510 that extends forwardly from the reflector and a second portion 520 that extends substantially parallel to the reflector. The second portion 520 is mechanically and galvanically connected to a rear section of the first portion 510. The parasitic element 500 including the first and second portions 510, 520 is configured as an integral piece having a generally L-shaped horizontal section. The horizontal section of a parasitic element referred to herein means a cross-section along the horizontal direction when the parasitic element is mounted on a base station antenna and the base station antenna is mounted for operating. For example, the parasitic element 500 may be stamped and formed of a metal plate. The second portion 520 is provided with an opening 521 for receiving a fastener to mount the parasitic element 500 to the reflector through the fastener. A dielectric material may be disposed between the second portion 520 and the reflector, so that the first portion 510 is capacitively coupled to the reflector through the second portion 520. The second portion 520 has a punched opening 522 so as to reduce the weight and metal use of the parasitic element 500.

As shown in FIG. 5B, the parasitic element 500' having a generally L-shaped horizontal section includes a first portion 510 and a second portion 530 that are integrally formed by stamping a metal plate. The parasitic element 500' is mounted to the reflector by passing a fastener through an opening 531 provided in the second portion 530, and the first portion 510 is capacitively coupled to the reflector through the second portion 530. Any of the parasitic elements 441-1, 443-2 (446-1), and 444-2 in the antenna assembly 400 described above may be implemented as the parasitic element 500 or 500'. As shown in FIG. 5C, the parasitic element 500" having a generally T-shaped horizontal section includes a first portion 510 and a second portion 540. The second portion 540 extends parallel to the reflector from the rear section of the first portion 510 on both sides of the first portion 510. The first portion 510 is capacitively coupled to the reflector through the second portion 540.

Figure 7A:
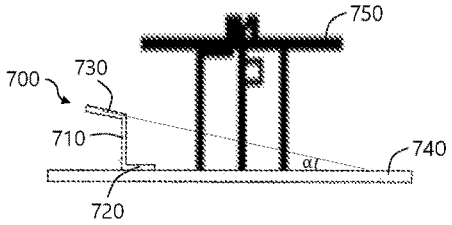
FIG. 7A is a top view schematically showing an antenna assembly of a base station antenna according to an embodiment of the present invention.
Figure 7B:
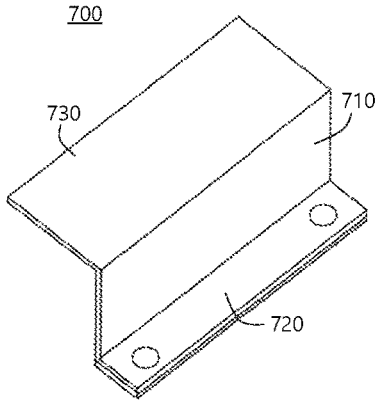
FIG. 7B is a perspective view schematically showing the parasitic element in the antenna assembly in FIG. 7A.

In an embodiment, as shown in FIGS. 7A and 7B, a parasitic element 700 includes a first portion 710 that extends forwardly from the reflector 740 and is substantially perpendicular to reflector 740, a second portion 720 that extends substantially parallel to the reflector 740 from a rear section of the first portion 710, and a third portion 730 that extends at an angle $\alpha$ relative to the reflector 740 from a front section of the first portion 710 in a direction that is away from the radiating element 750. The angle α is within the range of ±30 degrees. Any of the parasitic elements described above may be implemented as the parasitic element 700, such that the effect of the parasitic element array on the CPR over sector may be tuned by adjusting the extending length and angle α of the third portion 730 so as to achieve better performance.

Figure 6A:
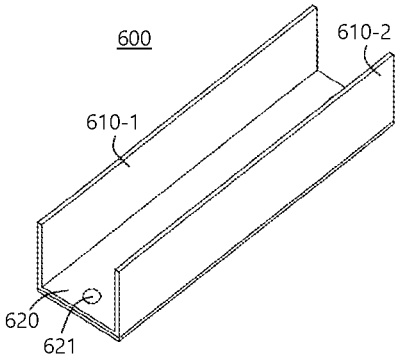
FIGS. 6A and 6B are perspective views schematically showing parasitic elements in base station antennas according to some embodiments of the present invention.
Figure 6B:
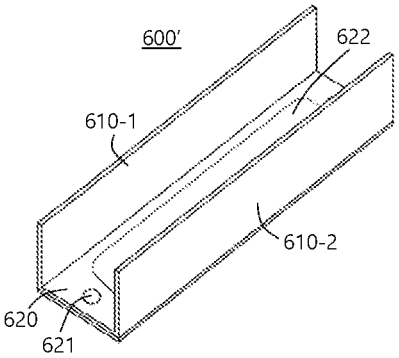

In some embodiments, the second portion of a parasitic element may also be mechanically connected to the rear section of the first portion of an adjacent parasitic element. In an embodiment, the two adjacent parasitic elements are configured as an integral piece having a generally U-shaped horizontal section and may be formed for example by stamping a metal plate. As shown in FIG. 6A, a parasitic element 600 having a generally U-shaped horizontal section includes portions 610-1, 610-2 and a portion 620. The portion 620 extends substantially parallel to the reflector. The portions 610-1 and 610-2 are connected to two opposite edges of the portion 620 and extend forwardly from the reflector and are substantially perpendicular to the reflector. The portions 610-1 and 610-2 may extend the same distance or different distances from the reflector. The portion 620 is provided with an opening 621 for receiving a fastener to mount the parasitic element 600 to the reflector through the fastener. A dielectric material may be disposed between the portion 620 and the reflector, so that the portions 610-1 and 610-2 are capacitively coupled to the reflector. As shown in FIG. 6B, a punched hole 622 is provided in a center section of the portion 620 of a parasitic element 600' so as to reduce the weight and metal use of the parasitic element 600'. Any pair of adjacent parasitic elements 442-1 and 443-1, 441-2 and 442-2, 444-1 and 445-1, and 445-2 and 446-2 in the antenna assembly 400 described above may be implemented as the parasitic element 600 or 600'.

Although some specific embodiments of the present invention have been described in detail with examples, it should be understood by a person skilled in the art that the above examples are only intended to be illustrative but not to limit the scope of the present invention. The embodiments disclosed herein can be combined arbitrarily with each other, without departing from the scope and spirit of the present invention. It should be understood by a person skilled in the art that the above embodiments can be modified without departing from the scope and spirit of the present invention. The scope of the present invention is defined by the attached claims.

The invention claimed is:

1. A base station antenna, comprising:

a reflector that is configured to provide a ground plane;

a first radiating element array including at least one first cross-polarized radiating element that is arranged in front of the reflector; and a first parasitic element array that includes first through third parasitic elements, wherein lateral distances from the first through third parasitic elements respectively to the at least one first cross-polarized radiating element increase sequentially.

2. A base station antenna, comprising:

a reflector that is configured to provide a ground plane;

a first radiating element array including at least one first cross-polarized radiating element that is arranged in front of the reflector; and parasitic elements configured to extend at an angle of 45 degrees with respect to a corresponding dipole radiator of the at least one first cross-polarized radiating element, wherein the parasitic elements comprise a first parasitic element array including first through third parasitic element pairs that respectively extend substantially parallel to a first longitudinal axis of the at least one first cross-polarized radiating element and are respectively coupled to the reflector, wherein each of the first through third parasitic element pairs includes a pair of parasitic elements that are arranged substantially symmetrically on both sides of the first longitudinal axis, and distances from the first through third parasitic element pairs respectively to the first longitudinal axis increase sequentially, wherein projections of any two of the first parasitic element pair, the second parasitic element pair, the third parasitic element pair, and the at least one first cross-polarized radiating element on the first longitudinal axis at least partly overlap.

3. The base station antenna according to claim 2, wherein a projection of each of the first through third parasitic element pairs on the first longitudinal axis extends over an entire projection of the at least one first cross-polarized radiating element on the first longitudinal axis.

4. The base station antenna according to claim 2, wherein a projection of each of the first through third parasitic element pairs on the first longitudinal axis extends over an entire projection of the first radiating element array on the first longitudinal axis.

5. The base station antenna according to claim 4, wherein a distance that a first conductor of a parasitic element that is closer to the first longitudinal axis extends forwardly from the reflector is less than a distance that a first conductor of another parasitic element that is farther from the first longitudinal axis extends forwardly from the reflector.

6. The base station antenna according to claim 4, wherein at least one parasitic element of at least one of the first through third parasitic element pairs further includes a second portion that extends substantially parallel to the reflector, the second portion includes a second conductor, the second portion is mechanically connected to a rear section of the first portion, and the at least one parasitic element is coupled to the reflector through the second conductor.

7. The base station antenna according to claim 6, wherein the at least one parasitic element is configured as an integral piece having a generally L-shaped or T-shaped horizontal section.

8. The base station antenna according to claim 6, wherein the second portion is further mechanically connected to a rear section of a first portion of an adjacent parasitic element of the at least one parasitic element, and the adjacent parasitic element is coupled to the reflector through the second conductor.

9. The base station antenna according to claim 8, wherein the at least one parasitic element and the adjacent parasitic element are configured as an integral piece having a generally U-shaped horizontal section.

10. The base station antenna according to claim 6, wherein the second conductor is galvanically connected to the reflector.

11. The base station antenna according to claim 6, wherein the second conductor is capacitively coupled to the reflector.

12. The base station antenna according to claim 6, wherein the second portion includes an opening.

13. The base station antenna according to claim 2, wherein each parasitic element of each of the first through third parasitic element pairs includes a first portion that extends forwardly from the reflector, the first portion includes a first conductor, and a distance that the first conductor extends forwardly from the reflector is less than or substantially equal to a distance that the at least one first cross-polarized radiating element extends forwardly from the reflector.

14. The base station antenna according to claim 13, wherein at least one parasitic element of at least one of the first through third parasitic element pairs further includes a third portion that extends at a first angle relative to the reflector and extends from a front section of the first portion in a direction that is away from the first longitudinal axis, the third portion includes a third conductor, and the first angle is within a range of ±30 degrees.

15. The base station antenna according to claim 2, wherein each parasitic element of one of the first through third parasitic element pairs includes a plurality of parasitic cells that extend substantially parallel to the first longitudinal axis and are spaced apart from each other.

16. The base station antenna according to claim 15, wherein the first radiating element array comprises a plurality of first cross-polarized radiating elements that are arranged substantially along the first longitudinal axis, and a projection of each of the plurality of parasitic cells on the first longitudinal axis and a projection of a corresponding first cross-polarized radiating element on the first longitudinal axis at least partly overlap.

17. The base station antenna of claim 16, wherein the projection of each of the plurality of parasitic cells on the first longitudinal axis extends over an entire projection of a corresponding first cross-polarized radiating element on the first longitudinal axis.

18. The base station antenna according to claim 2, further comprising:

a second radiating element array including at least one second cross-polarized radiating element that is arranged on the reflector; and a second parasitic element array including fourth through sixth parasitic element pairs that respectively extend substantially parallel to a second longitudinal axis of the at least one second cross-polarized radiating element and are respectively coupled to the reflector, wherein each of the fourth through sixth parasitic element pairs includes a pair of parasitic elements that are arranged substantially symmetrically on both sides of the second longitudinal axis, and distances respectively from the fourth through sixth parasitic element pairs to the second longitudinal axis increase sequentially, wherein, projections of any two of the fourth parasitic element pair, the fifth parasitic element pair, the sixth parasitic element pair, and the at least one second cross-polarized radiating element on the second longitudinal axis at least partly overlap, and a parasitic element of the sixth parasitic element pair that is located on a side of the second longitudinal axis that is close to the first longitudinal axis and a parasitic element of the third parasitic element pair that is located on a side of the first longitudinal axis that is close to the second longitudinal axis have a common portion.

19. The base station antenna according to claim 2, wherein:

the reflector has a forwardly-extending flange on an edge that is on a first side of the first longitudinal axis, and a parasitic element of the third parasitic element pair that is located on the first side of the first longitudinal axis and the flange have a common portion.

20. A base station antenna, comprising:

a reflector that is configured to provide a ground plane;

a radiating element array including horizontally adjacent first and second columns of cross-polarized radiating elements that are respectively arranged on the reflector substantially parallel to a longitudinal axis of the base station antenna, wherein the first column includes a first radiating element, the second column includes a second radiating element; and a parasitic element array including first through fifth parasitic elements between the first and second columns that each extend substantially parallel to the longitudinal axis, extend forwardly from the reflector, and are coupled to the reflector, and the first through fifth parasitic elements are sequentially spaced apart from each other in a horizontal direction, wherein projections of any two of the first parasitic element, the second parasitic element, the third parasitic element, and the first radiating element on the longitudinal axis at least partly overlap, and projections of any two of the third parasitic element, the fourth parasitic element, the fifth parasitic element, and the second radiating element on the longitudinal axis at least partly overlap.

21. The base station antenna according to claim 20, wherein one or more of:

at least one of the first through fifth parasitic elements is configured to have a generally L-shaped or T-shaped horizontal section; and/or at least one pair of adjacent parasitic elements of the first through fifth parasitic elements is configured as an integral piece having a generally U-shaped horizontal section; and/or a distance that a leg of the U-shaped integral piece extends forwardly from the reflector is different from a distance that another leg of the U-shaped integral piece extends forwardly from the reflector.

22. The base station antenna according to claim 20, wherein distances that the first and fifth parasitic elements extends forwardly from the reflector are less than respective distances that the second and fourth parasitic elements extend forwardly from the reflector, and the distances that the second and fourth parasitic elements extend forwardly from the reflector are less than a distance that the third parasitic element extends forwardly from the reflector.

23. A base station antenna, comprising:

a reflector that is configured to provide a ground plane;

a cross-polarized radiating element that is arranged on the reflector; and a parasitic element array that includes first through third parasitic element pairs that respectively extend substantially parallel to a horizontal axis of the radiating element and are respectively coupled to the reflector, wherein each of the first through third parasitic element pairs includes a pair of parasitic elements that are arranged substantially symmetrically on both sides of the horizontal axis, and distances from the first through third parasitic element pairs respectively to the horizontal axis increase sequentially, wherein projections of any two of the first parasitic element pair, the second parasitic element pair, the third parasitic element pair, and the radiating element on the horizontal axis at least partly overlap.

* * * * *